United States Patent [19]

Caisley

[11] 4,115,962

[45] Sep. 26, 1978

[54] PREFABRICATED BUILDING STRUCTURE

[76] Inventor: Ronald Caisley, Mansfield, Canada, L0N 1M0

[21] Appl. No.: 742,312

[22] Filed: Nov. 15, 1976

[30] Foreign Application Priority Data

Nov. 14, 1975 [GB] United Kingdom ..... 47064/75

[51] Int. Cl.[2] ..... E04H 1/00

[52] U.S. Cl. ..... 52/79.4; 52/90; 52/236.6

[58] Field of Search ..... 52/79.4, 79.1, 79.9, 52/234, 236.1–236.6, 80, 86, 90, 143

[56] References Cited

U.S. PATENT DOCUMENTS

| | | | |
|---|---|---|---|
| 2,765,499 | 10/1956 | Couse | 52/403 |
| 2,780,843 | 2/1957 | Sherbinin | 52/236.3 |
| 3,378,966 | 4/1968 | Lindal | 52/236.6 |
| 3,713,258 | 1/1973 | Svensson | 52/236.6 |

FOREIGN PATENT DOCUMENTS

| | | | |
|---|---|---|---|
| 158,564 | 9/1954 | Australia | 52/79.5 |
| 1,336,456 | 7/1963 | France | 52/79.1 |
| 431,912 | 9/1967 | Switzerland | 52/79.1 |

*Primary Examiner*—J. Karl Bell

*Attorney, Agent, or Firm*—Rogers, Bereskin & Parr

[57] ABSTRACT

The invention provides a basic core structure which can be used as a basis for home. Permutations of prebuilt wall panels can be added to build a two-storey structure. Consequently, because the floor area is spread out over two storeys the length of the basic core can be less than the length of a mobile home having the same floor area. The core can be made on wheels for easy movement and the panels are made as light as possible for simplicity of assembly and disassembly.

8 Claims, 11 Drawing Figures

PREFABRICATED BUILDING STRUCTURE

This invention relates to a prefabricated building structure of a type suitable for use as a home or other similar smaller building.

The high cost of building conventional homes has caused various types of structures to be developed in attempts to provide less expensive accommodation. One such structure is known as a mobile home because it is delivered on wheels and can be moved from one location to another. Such homes have grown to a size such that they are moveable only under the control of specialists and often they are carried on a flat-bed truck.

A second structure which has been developed is known as a prefabricated home. These structures are delivered in factory assembled parts which can be assembled on site. However, prefabricated homes are generally not intended to be disassembled for use at another site. The main advantage of these structures is that they tend to be less expensive because of the use of factory prefabrication.

The present invention is intended to make use both of some of the advantages of a mobile home as well as some of the advantages of prefabricated homes to provide a structure which is readily assembled on site and which can also be disassembled and readily moved to another location.

Accordingly, the invention provides a basic core structure which can be used as a basis for a home. Permutations of prebuilt wall panels can be added to build a two-storey structure. Consequently, because the floor area is spread out over two storeys the length of the basic core can be less than the length of a mobile home having the same floor area. The core can be made on wheels for easy movement and the panels are made as light as possible for simplicity of assembly and disassembly.

The invention will be better understood with reference to the drawings, in which.

Figure 1:
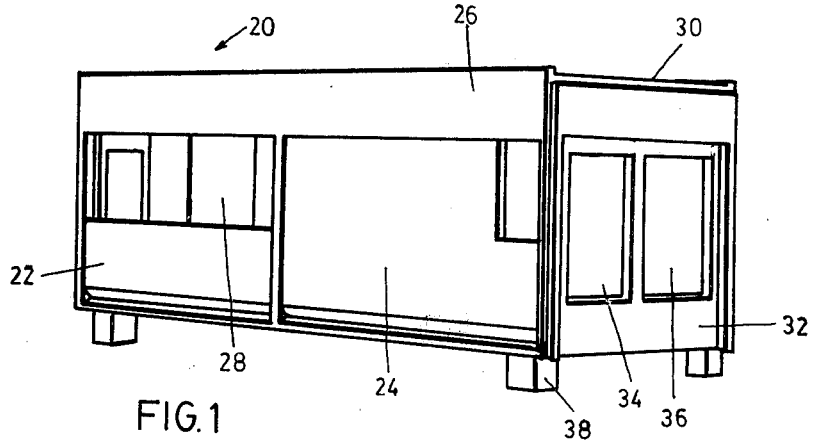
FIG. 1 is a perspective view drawn somewhat diagrammatically to illustrate a typical core structure which incorporates the invention.

Reference is first made to FIG. 1 which illustrates a factory-assembled service core 20 in the form in which it is transported. An interior floor extension 22 and a patio floor extension 24 are folded up into a position in which they are flush with the side of the core as shown in the drawing. The top of the core 20 is defined by a bridge 26 which will be more fully described with reference to subsequent drawings. The bridge serves both as a roof for the first level and a floor for a second level and is to be considered as a load bearing element of the structure. An end 32 of the core is assembled with openings 34, 36 which serve as windows and the core is positioned on supports 38 which can be concrete construction blocks.

Although not shown in FIG. 1, the core could be mounted on wheels and a towing bracket provided in the manner used on conventional mobile homes.

Figure 2:
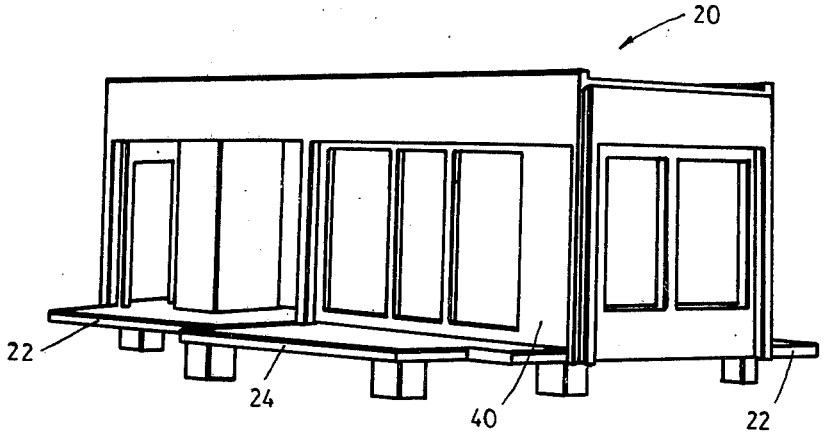
FIGS. 2 to 4 illustrate a structure based on the core in various stages of completion.

FIG. 2 illustrates the core 20 with the floor extension 22 and the patio extension 24 lowered into place and illustrates the relatively open side of the structure. A patio frame 40 is assembled in the core 20 at the factory to define a middle floor and flanking windows.

Figure 3:
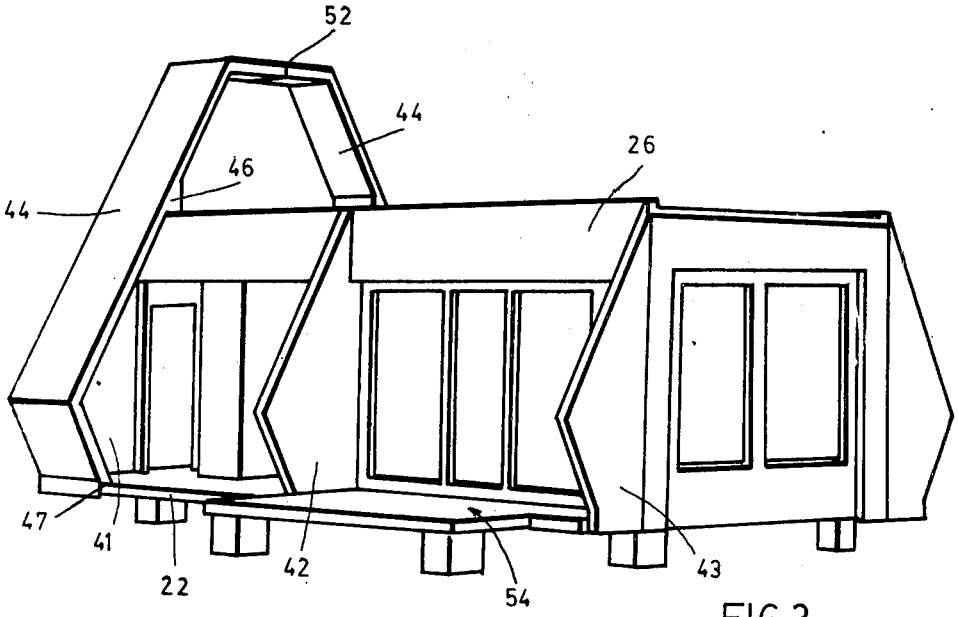

After the floor extension 22 and patio extension 24 have been positioned, the assembly is further developed by adding upright side supports 41, 42 and 43 as seen in FIG. 3. These side supports are attached to the core 20 and side panels 44 are then attached to the core as indicated in FIG. 3. The side panels 44 are constructed with an abutment 46 which sits on the bridge 26 such that the lower edge of the major portion of the load is taken directly on the bridge 26.

The bridge 26 is conveniently of a U-shaped section (as will be described with reference to FIG. 8) and can be of a similar section in an inverted position. In any event, the strength of a U-shaped section is used to rigidify the structure and to support the side panels 44.

Returning to FIG. 3, the side panels 44 shown in this drawing meet at a flush joint 52 and are connected by suitable fasteners such as the type to be described with reference to subsequent drawings.

Figure 4:
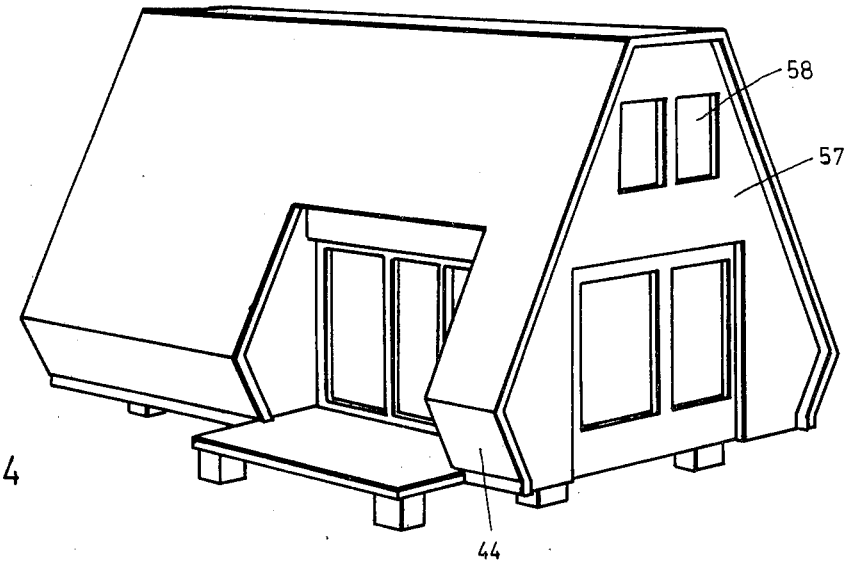

As seen in FIG. 4, panels such as 44 shown in FIG. 3 are added to complete the roof and side walls and end sections 57 complete the structure. This end section contains a window 58.

Figure 5:
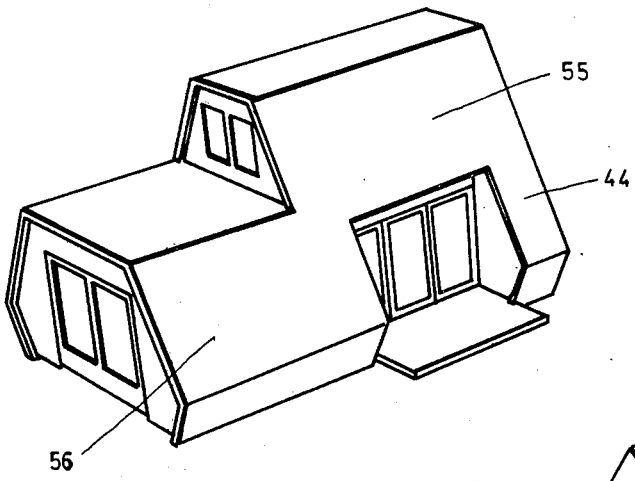
FIG. 5 is a perspective view showing a further structure based on the core.
Figure 6:
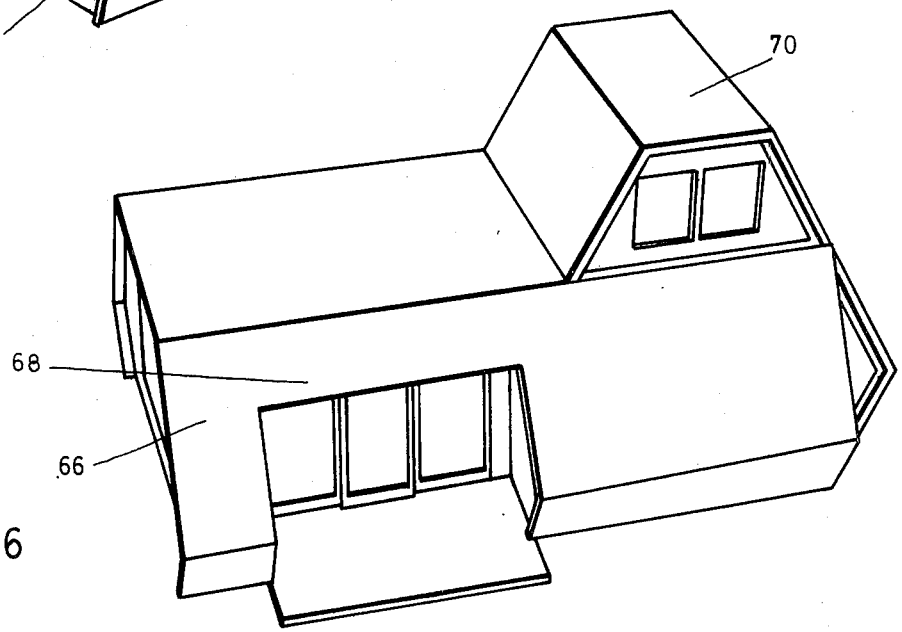
FIG. 6 is a further perspective view showing another embodiment of a building structure.

Reference is now made to FIGS. 5 and 6 which show further arrangements of panels associated with a basic core to develop different embodiments of the structure. In FIG. 5, shorter side panels 55 are used in conjunction with the panels 44 and in FIG. 6, the side panels are used over the end of the core to develop a transversely running roof line to further develop a different style of structure.

It will be evident that many variations are possible within the basic concept of providing a core having a base, end walls and a bridge for receiving side panels such as the panels 44. An important aspect of the structure is that the bridge should be substantially self-supporting so that the side walls of the core can be left open and so that an upper storey or second floor can be added to the structure.

Figure 7:
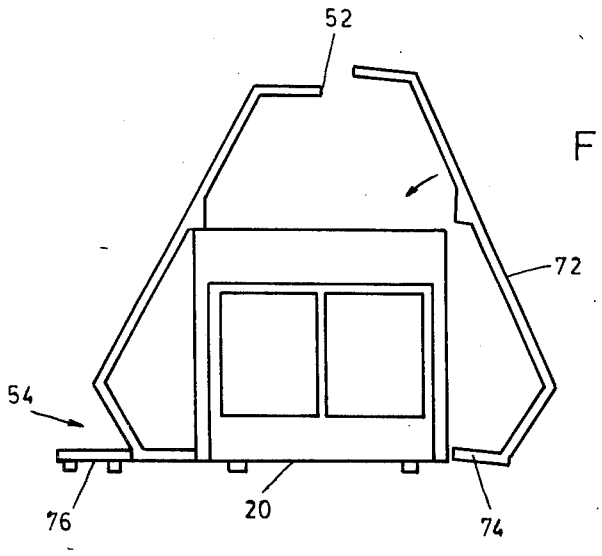
FIG. 7 is an end view illustrating the assembly of still another embodiment of a building structure incorporating the invention.

Reference is now made to FIG. 7 which illustrates an embodiment of the invention utilizing a modified side panel 72. The side panel 72 is of one piece construction and incorporates an interior floor extension 74. Opposing side panels 72 are connected at an upper joint 52 and the floor extension 74 is connected to the core such that the floor of the structure is continuous. A patio platform 76 is independently supported to accommodate a patio area 54. Up to this point in the description only the general shape and interrelationship of the parts has been described in order to better understand the concept of the invention. No details have been discussed and at this point it will be convenient to describe some of the construction details necessary for building a preferred embodiment of a structure according to the invention. It will also be appreciated that many of the structural details will be conventional in nature. E.g. door frames, window frames, plumbing, heating, lighting, etc. will all be substantially conventional. The present description is intended to highlight the inventive concept without the addition of unnecessary details which is a matter for persons skilled in the art.

Figure 8:
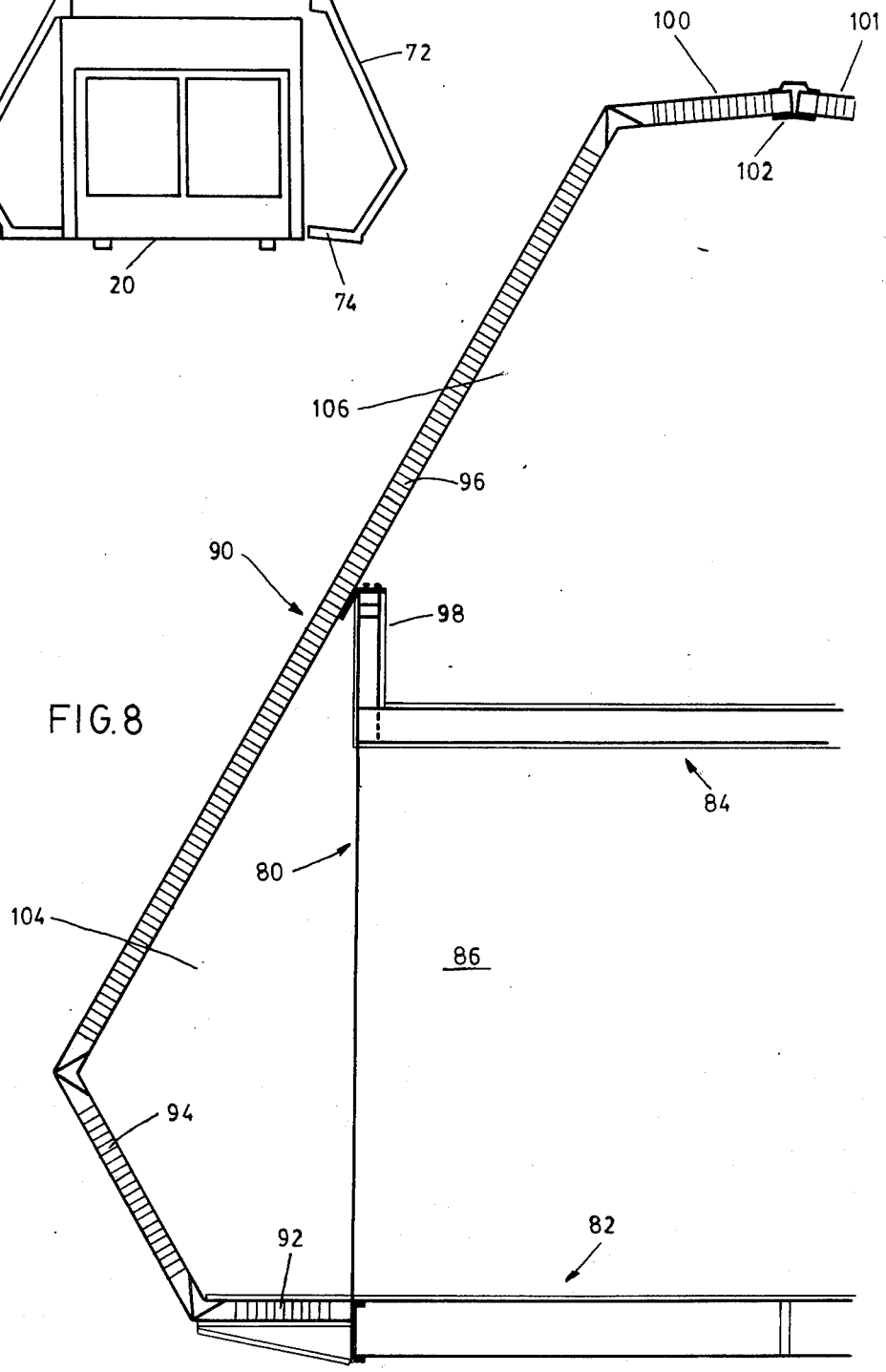
FIG. 8 is a sectional view in more detail of part of a preferred building assembly incorporating the invention.

Reference is now made to FIG. 8 which is a cross-sectional view of a building built according to the invention and showing slightly more than half of the cross-section. Because the cross-section is symmetrical about a vertical centre line, the view is representative of the full cross-section. This Fig. illustrates a core 80 having a base 82 and a bridge 84. The core also includes a pair of end structures 86 (one of which is seen) which support the bridge 84 above the base 82. Outriggers 88 are attached to the sides of the core base 82 to support side panels 90. These panels include a floor portion 92, an outwardly inclined lower portion 94 extending from the floor portion 92 and meeting an inwardly and upwardly inclined upper portion 96. This portion is attached to a side element 98 of the bridge 84 and extends to a top portion 100 which meets a similar top portion 101 of a further side panel at a top joint 102. The outriggers 88 therefore support the panel 90 and other similar panels and the panel is retained in position by attachment to the bridge 84 and by the top joint 102. As will be described joints extend vertically between adjacent panels and are connected by structure shown in FIG. 11.

It is important to appreciate that the core structure 80 is self-supporting and that the bridge 84 is built to receive and support the panels 90 and also to act as a floor for an upper storey of the structure.

The end structure 86 of the core 80 is supplemented by an end wall portion 104 at the ground level and by an upper end wall portion 106 above the bridge 84.

Figures 9, 10, 11:
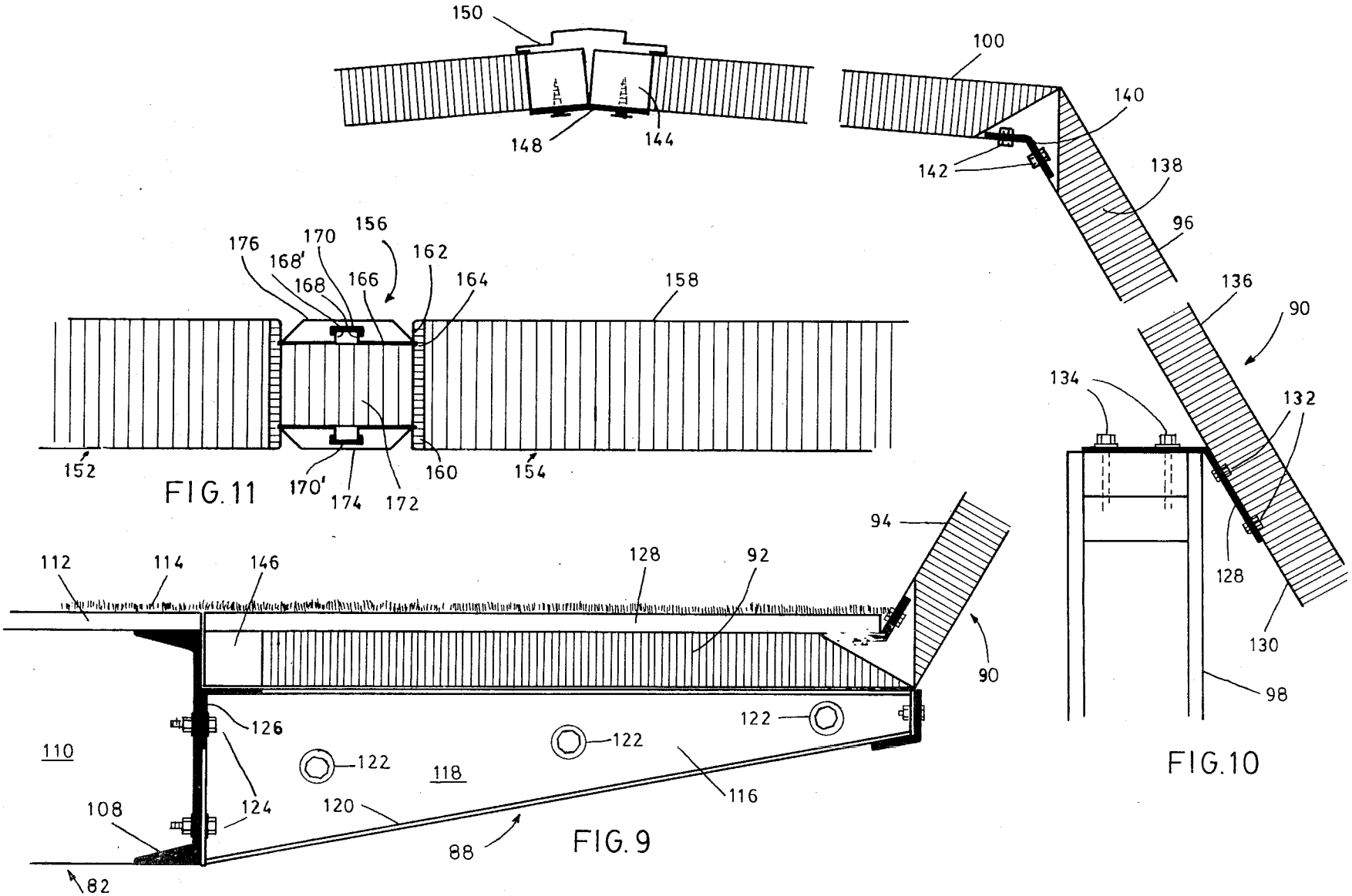
FIG. 9 is a cross-sectional view of part of the floor structure shown in FIG. 8.
FIG. 10 is a cross-sectional view of part of the outer wall and roof showing detail of the structure shown in FIG. 8.
FIG. 11 is a horizontal view of a joint used in making vertical joints between panels forming part of the structure shown in FIG. 8.

Details of the structure described in FIG. 8 are shown in more detail in FIGS. 9 to 11 inclusive.

As seen in FIG. 9, the base 82 consists essentially of a pair of longitudinally extending side girders 108 (one of which is seen in FIG. 9) connected by transverse joists 110 and supporting a floor 112 covered by a carpet 114.

The outriggers 88 each consist of a pair of back-to-back formed elements 116 consisting of a central panel 118 which narrows towards its outer extremity and which is surrounded by a peripheral flange 120 to stiffen the structure. The elements 116 are connected together in pairs by fasteners 122 and the outrigger is attached by suitable fasteners 124 to the girder 108. Between outriggers angle brackets 126 are provided and attached to the girder 108 to provide further support for side panel 90. The floor portion 92 of the side panel 90 rests on the outrigger and on the angle brackets 126 and an extension 128 of the floor 112 rests on the floor portion 92 and also supports the carpet 114.

As seen in FIG. 10, the side panel 90 is attached to side element 98 of the bridge 84 by a connecting plate 128. This plate is attached to an inner skin 130 of the panel 90 by suitable blind rivets 132 and to the top of the side element 98 by suitable coach bolts 134. The side element 98 is shown of wood construction but could be prefabricated from steel elements if preferred.

Reference is now made both to FIGS. 9 and 10 to describe the side panel 90 in more detail. As mentioned, this panel has an inner skin 130 of steel sheet and a similar outer skin 136. The skins are separated by insulation 138 of foam plastic or other suitable material.

Although the outer skin 136 is continuous, the inner skin 130 is formed in sections corresponding to the floor section, lower section, upper section and top section of the panel. The panel is made flat and the portions of the inner skin are separated from one another where the joints are to be formed between the top portion 100 and the upper portion 96; between the upper portion 96 and the lower portion 94; and between the lower portion 94 and the floor portion 92. It will be appreciated that the spacing is determined by the angle through which these portions are to be rotated relative to one another to form the shape of the panel. Once the panel has been formed into the shape shown in FIG. 8, internal plates such as plate 140 between sections 100 and 96 are attached by suitable rivets 142 to retain the panel in the shape shown. The space behind these plates is filled by forming a relatively rigid form in situ to provide strength at these joints. The ends of the panel also include sections of relatively rigid foam to improve the strength at the ends of the panels. At the upper end a filler 144 is provided and at the other end of the panel a filler 146 is provided.

The panels are connected at their tops by plates 148 and the joint is covered by a cap 150.

Reference is now made to FIG. 11 to illustrate the joint which runs vertically between adjacent panels. As shown in this drawing a pair of panels 152, 154 are connected by a joint 156. The skins of the panels are formed in similar fashion and a skin 158 is typical of the skins seen in this Fig. The skin 158 passes over a side filler 160, has a short transverse portion 162 and then defines a U-shaped portion 164, one leg of which, 166 extends outwardly and terminates in a transverse lip 168. This lip and an adjacent lip 168' of panel 152 are engaged by a channel section 170. This channel section draws the panels towards one another and into engagement with a preformed filler strip 172 of high density foamed plastic which acts both as an insulator and as a locator for the panels. A similar channel section 170' is provided on the opposite side of the filler strip 172. It will be appreciated that the resulting joint has no metal continuity from inside the structure to the outside so that there is insulation at all points in the structure. Also, the structure can be improved by the provision of respective internal and external covers 174, 176 which can be engaged with ends of the covers in the U-shaped portions such as the portion 164 in panel skin 158.

It will now be appreciated that some of the significant features of the structure include the provision of a central core having a structural top capable of providing a second storey and of supporting the side panels. Further, because of the shape of the structure services are readily provided at both levels. For instance, as seen in FIG. 8 the side element 98 meets the upper portion 96 of the panel 90 such that a space is provided externally of the side element 98. It will be appreciated that the ceiling at the lower level can be taken from the underside of the bridge 84 directly across to the panel so that there will be a triangular duct provided along the full length of the structure at both sides of the structure.

Another advantage of the structure is that the core provides the main structural element and can be shipped in one piece. The outriggers are readily added and consequently because the side panels are relatively light the overall structure can be assembled once the core is in position with a minimum of equipment and without the need for heavy lifting equipment.

What I claim is:

1. A building structure comprising a core having a base defining a rectangular ground floor, a pair of end walls extending upwardly from respective opposite sides of the ground floor, a bridge extending between and supported by the end walls, the bridge being a structural member and defining an upper floor above the ground floor; panel means coupled to the base and to the bridge to provide additional ground floor and to protect the sides of the ground floor and of the upper floor between the end walls, said panel means including upper portions inclined upwardly and over the upper floor and top portions extending from the respective upper portions to meet other such top portions above the upper floor and said panel means being coupled to the bridge at the upper inclined portions.

2. A building structure as claimed in claim 1 in which the panel means further includes lower portions extending downwardly and towards the base from the respective upper portions and terminating at said additional ground floor.

3. A building structure as claimed in claim 1 in which the panel means comprise outer skins in parallel and an insulating material trapped between the skins.

4. A building structure comprising a core having a base defining a rectangular ground floor, a pair of end walls extending upwardly from respective opposite sides of the ground floor, a bridge extending between and supported by the end walls, the bridge being a structural member and defining an upper floor above the ground floor; outriggers attached to the base at sides of the base extending between the end walls, the outriggers being spaced apart below the level of the ground floor; means defining additional ground floor and supported by the outriggers; and panel portions extending upwardly from outer extremities of the additional ground floor and including upper portions attached to the bridge and top portions attached to one another to enclose a space above the upper floor.

5. A building structure as claimed in claim 4 in which the bridge includes parallel side elements above respective sides of the ground floor extending between the end supports, said upper portions being attached to the upper extremities of the respective side elements.

6. A building structure comprising a core having a base defining a rectangular ground floor, a pair of end walls extending upwardly from respective opposite sides of the ground floor, a bridge extending between and supported by the end walls, the bridge being a structural member and defining an upper floor above the ground floor, outriggers attached to the base at sides of the base extending between the end walls, the outriggers being spaced apart below the level of the ground floor; a plurality of panel means each of which includes a floor portion supported on the outriggers and providing additional ground floor, a lower portion extending upwardly and outwardly to a level substantially below the bridge and being attached to an outer extremity of the floor portion, an upper portion extending upwardly from an upper extremity of the lower portion and being inclined to extend above and over the upper floor, this upper portion extending from an upper extremity of the upper portion over the upper floor terminating at an upper end; and means coupling said upper ends of each of the panel means to other upper ends to create a ridge over the upper floor and to thereby cover the upper floor.

7. A building structure as claimed in claim 6 in which the bridge includes parallel side elements above respective sides of the ground floor extending between the end supports, said upper portions of the panel means being attached to the respective side elements.

8. A building structure as claimed in claim 7 in which the panel means comprise outer skins in parallel and an insulating material trapped between the skins.

* * * * *